US005827991A

United States Patent [19]

Predazzer

[11] Patent Number: 5,827,991

[45] Date of Patent: Oct. 27, 1998

[54] FIRE ARM WITH MOVEABLE BARREL

[75] Inventor: René Predazzer, Flemalle, Belgium

[73] Assignee: FN Herstal S.A., Herstal, Belgium

[21] Appl. No.: 687,429

[22] PCT Filed: Dec. 12, 1995

[86] PCT No.: PCT/BE95/00115

§ 371 Date: Aug. 9, 1996

§ 102(e) Date: Aug. 9, 1996

[87] PCT Pub. No.: WO96/18860

PCT Pub. Date: Jun. 20, 1996

[30] Foreign Application Priority Data

Dec. 12, 1994 [BE] Belgium ..... 09401122

[51] Int. Cl.[6] ..... F41B 5/16; F41B 5/14

[52] U.S. Cl. ..... 89/161; 89/165; 89/178

[58] Field of Search ..... 89/161, 178, 164, 89/165, 166, 167, 172, 174

[56] References Cited

U.S. PATENT DOCUMENTS

| | | | |
|---|---|---|---|
| 922,173 | 5/1909 | Lovelace | 89/165 |
| 1,337,444 | 4/1920 | Douglas . | |
| 1,886,113 | 11/1932 | Lutton | 89/166 |
| 3,985,062 | 10/1976 | Hupp et al. | 89/159 |
| 5,347,912 | 9/1994 | Gathoye | 89/169 |

FOREIGN PATENT DOCUMENTS

| | | |
|---|---|---|
| 0 573 093 A1 | 12/1993 | European Pat. Off. . |
| 2262277 | 9/1975 | France . |
| 148445 | 2/1904 | Germany . |

*Primary Examiner*—Stephen M. Johnson
*Attorney, Agent, or Firm*—Bacon & Thomas

[57] ABSTRACT

A firearm with an automatic cycle, includes a frame (1), a barrel (2) mounted on this frame (1) and at least one breech bolt (3) mounted in a movable manner in relation to the frame, whereby the barrel (2) and the breech bolt (3) can be separated so as to make it possible to feed ammunition. The barrel (2) is also movable in relation to the frame (1), both forward and backward relative to a rest position, whereby the barrel (2) and the breech bolt (3) are mounted such that the barrel (2) can recoil together with the breech bolt (3) relative the rest position and can continue, when returning forward, can continue beyond the rest position and then return to the rest position, whereby the advancing of the barrel (2) beyond or forward of the rest position takes place at least partly after the separation of the barrel (2) and the breech bolt (3).

5 Claims, 2 Drawing Sheets

FIRE ARM WITH MOVEABLE BARREL

BACKGROUND OF THE INVENTION

1. Field of the Invention

The invention concerns a firearm with an automatic cycle, including a frame, a barrel mounted on this frame and at least one breech bolt mounted in a movable manner relative to the frame, wherein the barrel and the breech bolt can be separated so as to make it possible to discharge a spent ammunition casing and to feed new ammunition.

2. Related Technology

In the known firearms of this type, the barrel is fixed relative to the frame or can only be moved between a rest position and a rearward position.

As a result, the firearm is relatively long.

The minimum length of a firearm, indeed, depends on the length of the barrel, which is required for the ballistic function, the length of the part of the element to close the firing chamber being situated behind the barrel, such length being imposed by the geometry and the functions of this element and the backward travel of the moveable elements.

This backward travel in turn depends on the length of the ammunition cartridge to be fed, since a minimum length of a feeding ramp is needed to make it possible for the cartridge to progressively ascend from the level of a loader to the level of the firing chamber and to allow the relative shifting of the breech bolt/slide as a whole according to kinematic principles, this shifting constituting, for example, the release movement in a gas-operated firearm with rotating breech bolt.

The invention aims to reduce the length of the firearm significantly.

BRIEF SUMMARY OF THE INVENTION

To this aim, the barrel is made and supported so as to be also movable in relation to the frame, both forward and backward in relation to a rest position, and the barrel and the breech bolt are mounted such that the barrel can recoil together with the breech bolt relative to the rest position and the barrel can continue, when returning forward, its motion beyond the rest position to a forward recoil position and then return to the rest position. The motion of the barrel beyond the rest position takes place at least partly after the separation of the barrel and the breech bolt.

Firearms are known in which the barrel can move forward relative to a rest position, but in these arms the barrel moves forward simultaneously with the projectile being fired, which naturally amplifies the motion that is transmitted to the frame and thus increases the discomfort of the shooter.

According to a preferred embodiment of the invention, the firearm contains two springs, i.e. a rearward recoil spring to push forward the assembly consisting of the barrel and the breech bolt after the recoil and a forward recoil (counter recoil) spring to push the barrel from its forward most position back to the rest position.

Preferably, the firearm contains a slide which is movable in relation to the frame and which is part of the above-mentioned assembly which can be moved backward and which consists of the breech bolt and the barrel, whereby the recoil spring mounted between the frame and the slide is compressed during the recoil, and the advance spring is mounted between the frame and the barrel and is compressed during the motion of the barrel beyond the rest position.

DESCRIPTION OF THE DRAWINGS

In order to better explain the characteristics of the invention, the following embodiment of the invention is described as an example only without being limitative in any way, with reference to the accompanying drawings, in which.

DETAILED DESCRIPTION OF THE PREFERRED EMBODIMENT

Figure 1:
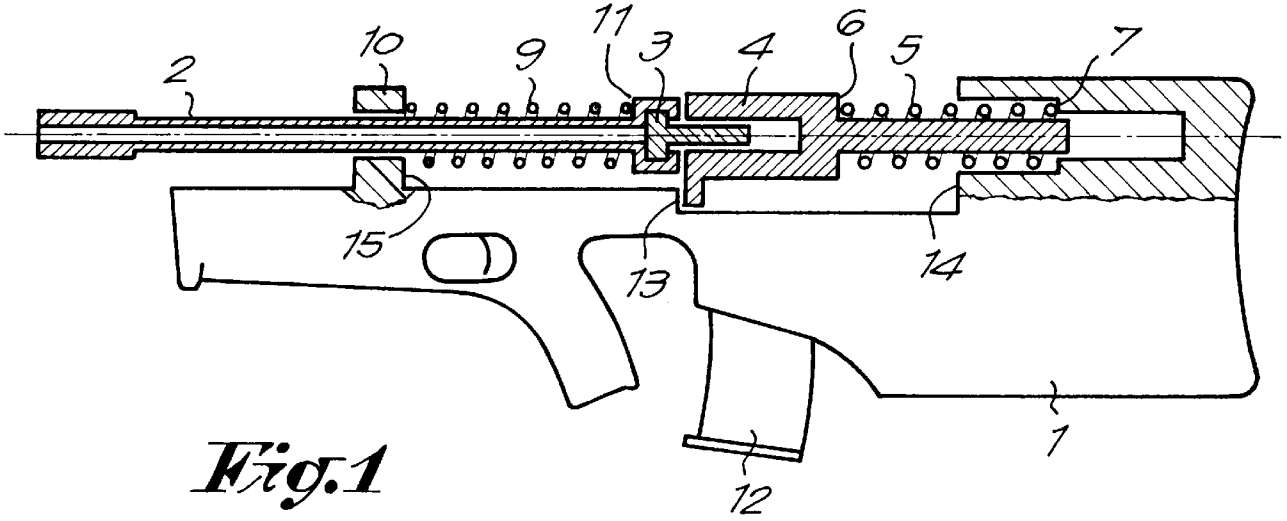
FIG. 1 shows a schematic side view in partial section of a firearm according to the invention and in a rest position.

The firearm represented in the drawings is an automatic firearm which mainly consists of a frame 1, on the one hand, and a barrel 2, on the other hand; a breech bolt 3, and a slide 4 mounted in a movable manner in the longitudinal direction of the firearm on the frame 1.

Figure 2:
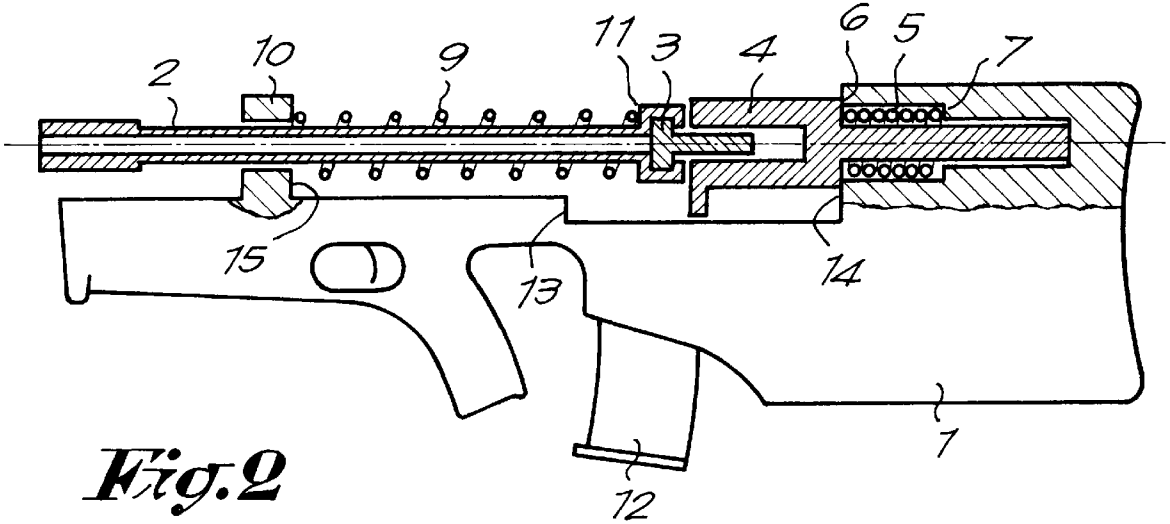
FIG. 2 shows a view analogous to that of FIG. 1, but with the movable elements of the firearm in recoil position.

The whole consisting of the barrel 2, the breech bolt 3 and the slide 4 can travel over a short recoil path of motion relative to a position as seen in FIG. 1 while compressing a rearward recoil spring 5, as shown in FIG. 2.

This recoil spring 5 is situated between an abutment 6 of the slide and a radial wall 7 formed in the frame 1.

The breech bolt 3 can be constructed in a conventional manner and may consist of, for example, a rotating breech bolt which can react the pressure in the ammunition firing chamber that it locks.

This breech bolt 3 can be separated from the barrel 2 in an uninterrupted continuous manner.

The barrel 2, after being separated from its breech bolt 3, can move forward relative to the above-mentioned rest position while compressing an advance spring 9 which surrounds a part of the barrel 2 and which is situated between a part 10 of the frame 1 and a radial rim 11 on the rear end of the barrel 2.

During the latter travel, the automatic cycle including the possible extraction/ejection of an ammunition spent casing and the feeding of the next ammunition round can take place.

The feeding device of the ammunition round can be of a known construction and as a consequence is not described here. A difference with conventional firearms is that the feeding device must ensure the exit of the cartridge from the loader clip 12, its upward motion to the level of the barrel chamber and its introduction into the chamber, which was previously emptied, during the travel motion of the barrel 2 and not during the travel motion of the slide as schematically illustrated in FIG. 3.

Figure 3:
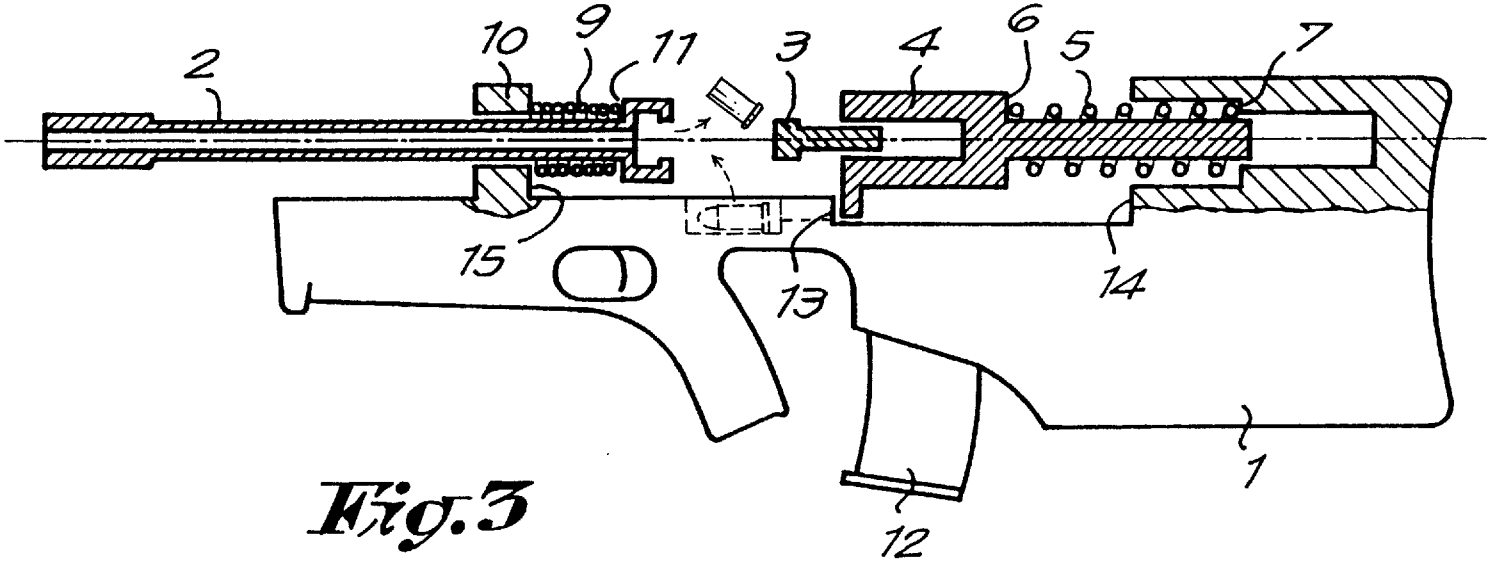
FIG. 3 shows a view analogous to those according to FIGS. 1 and 2, with the movable elements of the firearm in a third position.

A conventional extractor and a conventional ejector with spring can be used to empty the firing chamber and to eject the case as schematically illustrated in FIG. 3.

The feeding function, which conventionally requires a relatively large mass to obtain the necessary kinematic energy to work properly, must no longer be provided by the slide, which allows for a lighter construction of this element. Apart from this, said slide still has its conventional functions, such as for example in the case of a rotating breech bolt, the control over the rotation of the breech bolt by means of a suitable ramp when the breech bolt extends relative to the slide, and such as the support of a part of the percussion element.

Said percussion element can be made in the conventional manner as is known by the person skilled in the art.

In the rest position, i.e. before a firing, the movable elements consisting of the barrel 2, the breech bolt 3 and the slide 4 are situated in the position as represented in FIG. 1, forming an assembly.

At this position, the recoil spring 5 and the advance spring 9 are pre-compressed, whereby the recoil spring 5 is pre-compressed significantly more than the advance spring 9.

To this end, the slide 4 is pushed forward against the stop 13 formed by a part of the frame 1.

The slide 4, the breech bolt 3 and the barrel 2 form one piece with one another, and these elements form an assembly 2-3-4 which can recoil rearwardly from the above-mentioned rest position.

In the chamber is situated an ammunition cartridge and, after the firing of this cartridge, the motion generated as the projectile of the cartridge or round and the combustion gases gain speed entails a recoil of the above-mentioned assembly 2-3-4.

Due to this recoil, the recoil spring 5 is compressed and the slide 4 is stopped by a rear stop 14 consisting of a part of the frame 1, as shown in FIG. 2.

The kinematic energy of this movable assembly 2-3-4 is accumulated in the recoil spring 5. This energy, minus the possible transfer of energy of the advance spring 9, then thrusts the assembly 2-3-4 forward.

The surplus of the energy transmitted to the movable assembly consisting of the barrel 2, the breech bolt 3 and the slide 4, and the potential accumulated energy difference is partly absorbed by the stop 14 and partly by the shooter or a gun mounting.

If required, the rear stop 14 may consist of a damping device to improve the reproductivity of the kinematics of the firearm, to improve the comfort of the shooter or to restrict the strains transmitted to the firearm structure.

During its forward movement, the slide 4 stops against the stop 13. This stop may also include a damping device if required.

As a result of inertia, the barrel 2 and the breech bolt 3, which still form one piece, continue their forward movement, which causes a separation (i.e., relative movement) between the breech bolt 3 and the slide 4, which makes it possible for the latter to unlock the firing chamber, for example, making it possible for the latter to control the rotation of the breech bolt in a manner known as such.

After the breech bolt 3 has stopped and separated from barrel 2, the barrel 2 continues its forward movement beyond the rest position to a forward recoil position as a result of inertia, but somewhat slower as energy has been consumed by the unlocking of the firing chamber and the possible extraction of the spent cartridge casing.

During this forward movement, the barrel 2 compresses the advance spring 9 up to the front stop 15 formed by the rear side of the part 10 of the frame 1.

The firearm is represented in FIG. 3 at the moment when the barrel 2 is stopped by the front stop 15, whereat the advanced spring 9 is completely compressed.

The front stop 15 may also consist of a damping device if required.

As schematically illustrated in FIG. 3, during this forward movement, part of the ammunition feeding movement will be partially initiated. Also the ejection has been simply controlled, for example by means of a conventional ejector with a spring mounted in the breech bolt 3.

The kinetic energy of the barrel 2, after the firing chamber has been unlocked, has been partially stored as potential energy in the forward recoil spring 9.

Another part of the energy has been consumed during the partial ammunition feeding motion.

The surplus of energy will be divided between the absorption in an optional damped stop 15 and the energy transmitted to the frame 1 and to the shooter or the gun mounting.

The system will be optimized, in respect of the total mass of the firearm, the comfort of the shooter and the reliability of the mechanism according to different external conditions.

In particular, the potential energy of the forward recoil spring 9 will be such that, even under unfavorable working conditions, it is sufficient to finish the operating cycle.

To finish the operating cycle, after its forward travel, the barrel 2 returns rearwardly to the rest position as a result of the action of the forward recoil spring 9.

During this recoil, the barrel 2 stops the ammunition feeding action, makes contact with the breech bolt and pushes it back into the slide, so that it is locked in relation to the barrel.

The barrel 2 stops against the slide 4 which forms a stop for the barrel and which almost stays in contact with the stop 13. The side of the slide 4 which forms the stop for the barrel 2 may possibly be part of or associated with a damping device.

The firearm is again in the rest position (FIG. 1), ready for the next firing cycle.

The energy required for the cartridge percussion, which is generally set apart in the recoil of traditional slides, can here, thanks to the invention, be set apart during the recoil of the movable assembly of barrel 2, breech bolt 3 and slide 4, or as the barrel 2 alone moves forward, etc.

The above-described cycle illustrates the simplification achieved by the invention, since energy must no longer be transmitted to the slides as in conventional firearms (gas-operated or others), which saves costs and mass.

Further, as the ammunition is fired, the movable assembly of barrel 2, breech bolt 3 and slide 4 is effectively mounted on an elastic support, so that the strain of the shot on the shooter is intrinsically reduced.

Moreover, the recoil of the above-mentioned assembly is independent of the required feeding course and can be as short as the optimization of the embodiment makes possible as far as kinematics and strains are concerned, which allows for a significantly shorter recoil of the movable parts than in conventional firearms, as the latter recoil depends on the length of the ammunition to be fed.

Thus, the major advantage of the invention is that the total length of the firearm at rest (between firings) is significantly reduced.

It is true that the long forward course of the barrel 2 temporarily increases the total length of the firearm, but that is only when shooting and not while the firearm is at rest. Given the fact that the shooting necessarily takes place in a free space, the temporary lengthening does not hinder the handling of the firearm.

The invention also allows for a possible cost reduction of the firearm and a possible reduction of the mass.

The working of the advance and recoil mechanisms according to the invention does not increase the recoil impulse transmitted to the shooter or to the support. On the contrary, the strain of the shot which is transmitted to the shooter or to the firearm mounting are intrinsically reduced compared to firearms which are locked with a fixed barrel.

It is clear that numerous modifications can be made to the above-described example while still remaining within the scope of the invention.

I claim:

1. A firearm having an automatic cycle comprising:

a frame and a barrel associated with a firing chamber, said barrel mounted for longitudinal movement on the frame;

a breech bolt movably mounted relative to the frame and connected to the barrel for normally closing the firing chamber, said bolt being separable from the barrel;

said barrel and breech bolt being supported on the frame so as to be moveable together as an assembly in a rearward recoil direction from a rest position to a recoil position in reaction to firing of an ammunition round in the firing chamber with the chamber closed by the breech bolt, and to be moveable together forwardly from the recoil position up to the rest position, and so that the barrel is moveable from the recoil position forwardly beyond the rest position to a forward recoil position; and said barrel and breech bolt being arranged so that, upon at least partial movement of the barrel forwardly of the rest position, the barrel and breech bolt become separated from each other to permit extraction of a spent ammunition casing from and feeding of a fresh ammunition round into the firing chamber.

2. The firearm according to claim 1, including a rearward recoil spring and a forward recoil spring disposed between the barrel and relatively fixed firearm structure, said rearward recoil spring reacting rearward recoil motion of the barrel and breech bolt, and biasing the barrel and breech bolt forwardly toward the rest position; said forward recoil spring reacting forward recoil motion of the barrel and biasing the barrel reward toward the rest position.

3. The firearm according to claim 2, including a slide that is moveable as an assembly with the barrel and breech bolt relative to the frame at least from the rest position to the rearward recoil position; said rearward recoil spring being mounted between said slide and a relatively fixed structure of the firearm to bias the assembly of the barrel, breech bolt and slide forwardly toward the rest position from the rearward recoil position.

4. The firearm according to claim 2, wherein at the rest position of the barrel and breech bolt, said springs are in precompressed condition, the degree of precompression of the rearward recoil spring exceeding the precompression of the forward recoil spring.

5. The firearm according to claim 3, including a rearward recoil stop, a rest stop and a forward recoil stop associated with relatively said fixed structure, said stops being respectively located at said rearward recoil position, the rest position and the forward recoil position; said rearward recoil stop positively limiting rearward recoil movement of the barrel and breech bolt assembly; said forward stop positively limiting forward recoil motion of the barrel; and said rest stop positively limiting forward motion of the slide at the rest position.

* * * * *